US012636538B2

(12) United States Patent
Leipheimer

(10) Patent No.: US 12,636,538 B2
(45) Date of Patent: May 26, 2026

(54) TRAP BAR

(71) Applicant: Specialty Fitness Systems, LLC, Franklin, PA (US)

(72) Inventor: Jerry K. Leipheimer, Sharpsville, PA (US)

(73) Assignee: Specialty Fitness Systems, LLC, Franklin, PA (US)

( * ) Notice: Subject to any disclaimer, the term of this patent is extended or adjusted under 35 U.S.C. 154(b) by 297 days.

(21) Appl. No.: 18/338,727

(22) Filed: Jun. 21, 2023

(65) Prior Publication Data

US 2023/0414988 A1 Dec. 28, 2023

Related U.S. Application Data

(60) Provisional application No. 63/354,946, filed on Jun. 23, 2022.

(51) Int. Cl.
*A63B 21/072* (2006.01)
*A63B 21/075* (2006.01)

(52) U.S. Cl.
CPC ..... *A63B 21/0724* (2013.01); *A63B 21/0722* (2015.10); *A63B 21/075* (2013.01)

(58) Field of Classification Search
CPC ..... A63B 21/0722; A63B 21/0724; A63B 21/0728; A63B 21/075; A63B 21/4035; A63B 21/4039; A63B 71/023; A63B 2023/0411; A63B 2071/009; A63B 2071/025; A63B 2208/0223; A63B 2209/14; A63B 2225/09; A63B 2225/093
See application file for complete search history.

(56) References Cited

U.S. PATENT DOCUMENTS 5,836,858 A * 11/1998 Sharff ..... A63B 21/0724 482/106
6,004,245 A * 12/1999 Boos ..... A63B 21/0626 482/106
7,056,268 B2 * 6/2006 Emick ..... A63B 21/4035 482/106
8,235,872 B2 * 8/2012 Perry ..... A63B 21/4035 482/93
8,337,370 B2 12/2012 Rogers et al.
(Continued)

FOREIGN PATENT DOCUMENTS

CN 215841404 U 2/2022
WO 2013013358 A1 1/2013

OTHER PUBLICATIONS

"The Trap Bar HD", Kabuki Strength, 2022. [Retrieved at least prior to Jan. 28, 2022].

(Continued)

*Primary Examiner* — Joshua Lee
(74) *Attorney, Agent, or Firm* — The Webb Law Firm

(57) ABSTRACT

A trap bar assembly includes a central frame at least partially defining an open region, a pair of weight bars each extending from the central frame along a common axis, the common axis extending through the open region, and a frame bracket connected to the central frame. The frame bracket is removably connectable to any of a plurality of interchangeable handles. Each of the plurality of interchangeable handles comprises a handle bracket and a grip, wherein the handle bracket is removably connectable to the frame bracket.

13 Claims, 13 Drawing Sheets

(56) References Cited

U.S. PATENT DOCUMENTS

| | | | | |
|---|---|---|---|---|
| 8,992,394 | B2 * | 3/2015 | Mitchell | A63B 21/0724 482/93 |
| 9,005,088 | B2 * | 4/2015 | Sides, Jr. | A63B 21/4005 482/106 |
| 9,833,654 | B1 * | 12/2017 | Gant | A63B 21/4035 |
| 10,773,116 | B2 * | 9/2020 | Vanderbleek | A63B 21/4035 |
| 10,799,752 | B1 * | 10/2020 | Mattox | A63B 71/0036 |
| 10,881,893 | B2 * | 1/2021 | Welde | A63B 21/0724 |
| 11,241,601 | B2 * | 2/2022 | Sorin | A63B 21/0728 |
| 2019/0184226 | A1 | 6/2019 | Leipheimer | |
| 2021/0052934 | A1 * | 2/2021 | Mattox | A63B 21/0783 |
| 2023/0398398 | A1 * | 12/2023 | Pizer | A63B 21/4039 |

OTHER PUBLICATIONS

"Trap Bar Additional Handles", Kabuki Strength, 2022. [Retrieved at least prior to Jan. 28, 2022].

"Trap Bar HD Handle Brackets," Kabuki Strength, 2022. [Retrieved at least prior to Jan. 28, 2022].

* cited by examiner

TRAP BAR

CROSS-REFERENCE TO RELATED APPLICATION

This application claims the benefit of U.S. Provisional Patent Application No. 63/354,946, filed Jun. 23, 2022, the disclosure of which is hereby incorporated by reference in its entirety.

BACKGROUND OF THE INVENTION

Field of the Invention

This disclosure relates generally to exercise bars. More particularly, certain embodiments disclosed herein relate to a trap bar with an interchangeable handle and/or attachment.

Description of Related Art

Trap bars, also referred to as hex bars, are a weight training implement that can be used to perform a variety of weighted exercise movements. Conventional trap bars include a pair of axially aligned end bars separated by an open polygonal structure. The end bars are similar to the ends of a standard barbell in that weight plates can be slid and locked onto the end bars to adjust the weight of the trap bar. The polygonal structure includes a series of bars or tubes that connect the end bars while defining a central opening through which an axis of the end bars passes. A pair of handles is attached to the end bars and/or the polygonal structure. To perform exercises such as trap bar deadlifts or shoulder shrugs, the user stands with his/her feet in the central opening and lifts the trap bar around his/her legs. The weighted end bars are balanced on either side of the user. Trap bars can also be used to perform overhead presses, military presses, and various other exercises.

Conventional trap bars have several limitations. The handles are typically permanently connected and are not adjustable. This can create an uncomfortable grip when performing various exercises, particularly if the user is above or below average in size. Additionally, the fixed handles allow only one position of pronation/supination of the user's grip, which limits the amount of the muscle groups that can be targeted with an exercise. Conventional trap bars are also very limited in the exercises they can perform, with exercises like squats and different presses only being completed in an unorthodox way. Performing such exercises with conventional trap bars has certain drawbacks since the conventional trap bar was not designed to perform those exercises.

SUMMARY OF THE INVENTION

In view of the foregoing, there exists a need for a trap bar assembly having adjustable and/or interchangeable handles and/or other attachments. Accordingly, some embodiments of the present disclosure are directed to a trap bar assembly including a central frame at least partially defining an open region, a pair of weight bars each extending from the central frame along a common axis, the common axis extends through the open region, and a frame bracket connected to the central frame. The frame bracket is removably connectable to any of a plurality of interchangeable handles. Each of the plurality of interchangeable handles includes a handle bracket and a grip. The handle bracket is removably connectable to the frame bracket.

In some embodiments, a first of the plurality of interchangeable handles defines a different grip characteristic than a second of the plurality of interchangeable handles.

In some embodiments, the grip characteristic includes at least one of a grip width, a grip height, a grip size, and a grip angle.

In some embodiments, one of the frame bracket and the handle bracket includes at least one stud, and another of the frame bracket and the handle bracket includes at least one slot configured to receive the at least one stud.

In some embodiments, each of the at least one studs includes a shank and a head having a greater diameter than the shank.

In some embodiments, each of the at least one slots defines an enlarged portion and a narrow portion.

In some embodiments, the trap bar assembly further includes a popper pin mounted to the frame bracket. The popper pin is configured to engage an aperture in the handle bracket to prevent the handle bracket from sliding relative to the frame bracket.

Other embodiments of the present disclosure are directed to a trap bar assembly including a central frame at least partially defining an open region, a pair of weight bars each extending from the central frame along a common axis, the common axis extending through the open region, a frame bracket connected to the central frame, and handle. The handle includes a handle bracket removably connectable to the frame bracket and a grip connected to the handle bracket. One of the frame bracket and the handle bracket includes at least one stud, and another of the frame bracket and the handle bracket includes at least one slot configured to receive the at least one stud.

In some embodiments, each of the at least one studs includes a shank and a head having a greater diameter than the shank.

In some embodiments, each of the at least one slots defines an enlarged portion and a narrow portion, the enlarged portion is sufficiently large for the head of a corresponding stud to pass through, and the narrowed portion is too small for the head of the corresponding stud to pass through.

In some embodiments, the trap bar assembly further includes a popper pin mounted to the frame bracket. The popper pin is configured to engage an aperture in the handle bracket to prevent the handle bracket from sliding relative to the frame bracket.

In some embodiments, a number of slots is greater than a number of studs, and a height of the grip relative to the common axis is adjustable by changing which of the one or more slots are engaged to the one or more studs.

In some embodiments, the handle is connectable to the frame bracket in a first orientation, and the handle is connectable to the frame bracket in a second orientation rotated approximately 180° relative to the first orientation.

Other embodiments of the present disclosure are directed to a trap bar system including a central frame at least partially defining an open region, a pair of weight bars each extending from the central frame along a common axis, the common axis extends through the open region, a frame bracket connected to the central frame, a first handle including a first handle bracket and a first grip connected to the first handle bracket, and a second handle including a second handle bracket and a second grip connected to the second handle bracket. The frame bracket is removably connectable to the first handle bracket and to the second handle bracket.

In some embodiments, the first handle defines a different grip characteristic than the second handle.

In some embodiments, the grip characteristic includes at least one of a grip width, a grip height, a grip size, and a grip angle.

In some embodiments, the first handle includes a wing projecting from the grip.

In some embodiments, the first handle includes a rotatable mount that allows the grip to be rotated about an axis perpendicular to the common axis.

In some embodiments, each of the frame bracket, the first handle bracket, and the second handle bracket includes one of at least one stud, and at least one slot configured to receive the at least one stud.

In some embodiments, each of the at least one slots defines an enlarged portion and a narrow portion, the enlarged portion is sufficiently large for a head of a corresponding stud to pass through, and the narrowed portion is too small for the head of the corresponding stud to pass through.

Other embodiments of the present disclosure are directed to a utility bar assembly including a central frame at least partially defining an open region; a pair of weight bars each extending from the central frame along a common axis, wherein the common axis extends through the open region; a frame bracket connected to the central frame; and an interchangeable attachment selected from an interchangeable handle and a hip flex attachment. The frame bracket is removably connectable to the interchangeable attachment.

In some embodiments, the interchangeable attachment is a hip flex attachment including an attachment bracket removably connected to the frame bracket, a connecting portion connected to the frame bracket, and a padded portion positioned over at least a portion of the connecting portion.

In some embodiments, the interchangeable attachment includes an interchangeable handle including a handle bracket and a grip. The handle bracket is removably connectable to the frame bracket.

In some embodiments, the grip includes a connecting portion connected to the handle bracket, a grip portion connected to the connecting portion, and a padded portion positioned over at least a portion of the grip portion.

In some embodiments, the grip further includes a back-support portion connected to the connecting portion and configured to engage the upper back of a user.

In some embodiments, the handle bracket includes an elongated portion extending away from the grip, and a sleeve removably connected to the frame bracket. The sleeve is connected to and positioned around at least a portion of the elongated portion.

In some embodiments, the utility bar assembly further includes one or more wheels connected to the frame bracket and/or to the central frame.

These and other features and characteristics of a trap/utility bar assembly will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular forms of "a", "an", and "the" include plural referents unless the context clearly dictates otherwise.

DESCRIPTION OF THE INVENTION

For purposes of the description hereinafter, the terms "upper", "lower", "right", "left", "vertical", "horizontal", "top", "bottom", "lateral", "longitudinal", and derivatives thereof shall relate to the disclosure as it is oriented in the figures. However, it is to be understood that the disclosure may assume alternative variations and step sequences, except where expressly specified to the contrary. It is also to be understood that the specific devices and processes illustrated in the attached drawings and described in the following specification are simply exemplary aspects of the disclosure. Hence, specific dimensions and other physical characteristics related to the aspects disclosed herein are not to be considered as limiting.

As used herein, the terms "substantially" and "approximately", when modifying a number or range of numbers, mean within 10% of the stated value, unless indicated to the contrary. All numbers and ranges of numbers herein are understood to include a range of plus or minus 10% of the stated value, unless indicated to the contrary.

As used herein, the term "substantially planar" means a surface that has a degree of curvature of less than 5%.

As used herein, the term "at least one of" is synonymous with "one or more of". For example, the phrase "at least one of A, B, and C" means any one of A, B, and C, or any combination of any two or more of A, B, and C. For example, "at least one of A, B, and C" includes one or more of A alone; or one or more of B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of". For example, the phrase "at least two of D, E, and F" means any combination of any two or more of D, E, and F. For example, "at least two of D, E, and F" includes one or more of D and one or more of E; or one or more of D and one or more of F; or one or more of E and one or more of F; or one or more of all of D, E, and F.

Figure 1:
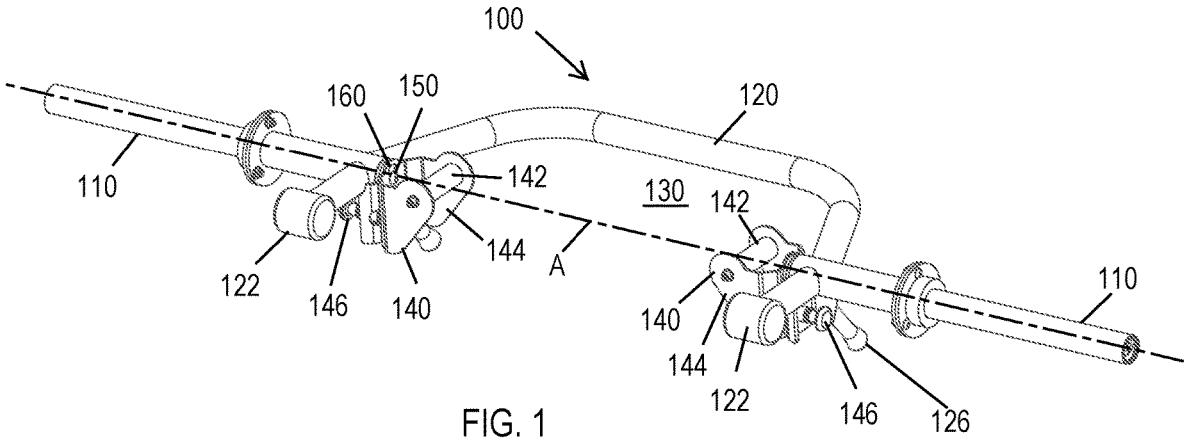
FIG. 1 is a perspective view of a trap bar assembly according to a non-limiting embodiment of the present disclosure.

Referring first to FIG. 1, a trap bar assembly 100 includes a pair of opposing weight bars 110 extending along a common axis A. Each of the weight bars 110 may be generally cylindrical and have a standard dimension for receiving conventional weight plates and bar clips. The weight bars 110 are connected to and spaced apart from one another by a central frame 120, which at least partially defines an open region 130. During use for exercises such as shoulder shrugs or trap bar deadlifts, a user stands in the open region 130 such that the weight bars 110 extend to the side of the user. The common axis A passes through the open region 130 and, consequently, passes through the body of the user when the user stands in the open region 130 to use the trap bar assembly 100. A pair of removable handles 140 are attached to the frame 120 and/or the weight bars 110, with the handles 140 extending into the open region 130. The user grasps the handles 140 in order to lift the trap bar assembly 100.

With continued reference to FIG. 1, the central frame 120 may take a variety of shapes. In the embodiments depicted in the accompanying drawings, the central frame 120 is polygonal and does not form a closed loop, such that the central frame 120 does not enclose a front side of the open region 130. In other embodiments, the central frame 120 may fully circumscribe the open region 130. As also shown in FIG. 1, the central frame 120 may include counterweights 122 extending forward from the weight bars 110. The counterweights 122 balance the central frame 120 such that the weight of the central frame 120 forward of the common axis A is approximately equal to the weight of the central frame 120 rearward of the common axis A. In some embodiments, the central frame 120 may further include one or more stands 126 that assists in raising the weight bars 110 off of the ground to facilitate easier removal of the weight plates from the weight bars 110. The stands 126 extend at an angle, for example approximately 40°, relative to the central frame 120. The central frame 120 can be rotated so that the stands 126 and a rear portion of the central frame 120 contact the ground, thereby raising the weight bars 110 and lifting the weight plates off of the ground for easy removal and replacement.

As indicated above, the handles 140 are removably mounted to the weight bars 110 and/or the central frame 120, such that the user can interchange the handles 140, adjust the mounting position of the handles 140, and/or adjust the orientation of the handles 140 as will be described in greater detail herein. In various embodiments, each of the handles 140 includes a grip 142 and a handle bracket 144 that connects to a corresponding frame bracket 124 of the weight bars 110 and/or the central frame 120. When connected to one another, the frame bracket 124 and the handle bracket 144 are substantially rigid, with substantially no movement occurring between the brackets 124, 144 during use of the trap bar assembly 100. The handle 140 may be attached and detached from the frame bracket 144 via a locking mechanism. In particular, the locking mechanism may include a spring-loaded pin (hereinafter "popper pin") 146 mounted to the frame bracket 124. The popper pin 146 is biased toward a locked position in which the popper pin 146 engages a corresponding aperture 148 (see, e.g., FIGS. 11-17) in the handle bracket 144.

Figure 2:
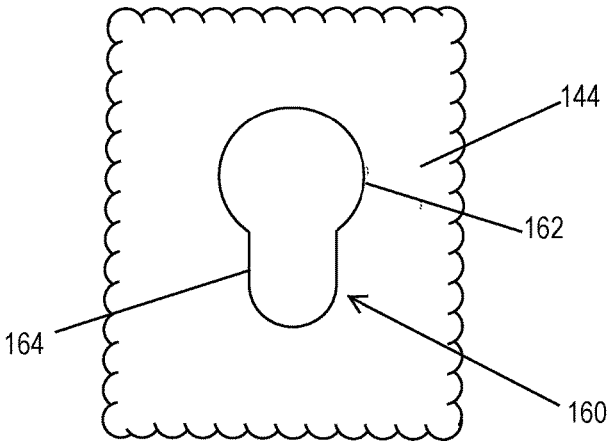
FIG. 2 is a diagram of a slot of a handle bracket of the trap bar assembly of FIG. 1 according to a non-limiting embodiment of the present disclosure.
Figure 3:
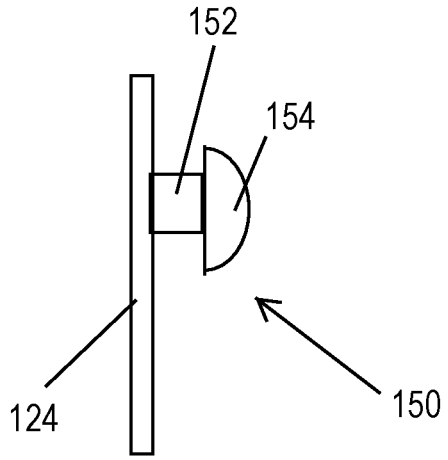
FIG. 3 is a diagram of a stud of a frame bracket of the trap bar assembly of FIG. 1 according to a non-limiting embodiment of the present disclosure.

The locking mechanism may further include one or more studs 150 extending from the frame bracket 124 and engaging one or more corresponding slots 160 in the handle bracket 144. In the embodiments shown in the accompanying drawings, each frame bracket 124 includes three studs 150, though more or less may be implemented. As shown in FIG. 2, each of the slots 160 in the handle bracket 144 includes an enlarged portion 162 and a narrow portion 164. As shown in FIG. 3, each of the one or more studs 150 may include a shank 152 extending perpendicular from the frame bracket 124 and a head 154 extending from a terminal end of the shank 152. The length of the shank 152 may be substantially equal to the thickness of the handle bracket 144. The head 154 of each stud 150 has a greater diameter than the shank 152. The enlarged portion 162 of the slot 160 is sufficiently sized for the head 154 of the stud 150 to pass through. The narrow portion 164 of the slot 160 is too small for the head 154 of the stud 150 to pass through, but sufficiently large for the shank 152 of the stud 150 to pass through. To connect the frame bracket 124 to the handle bracket 144, the enlarged portion 162 of the slot 160 is aligned with and slid over the head 154 of the stud 150. Once the head 154 of the stud 150 has cleared the slot 160, the handle bracket 144 is shifted along the plane of the slot 160 so that the shank 152 of the stud 150 enters the narrow portion 164 of the slot 160. As the head 154 of the stud 150 is too large to pass through the narrow portion 164 of the slot 160, the handle bracket 144 is constrained between the frame bracket 124 and the heads 154 of the studs 150. The handle bracket 144 cannot be pulled away from the frame bracket 124 unless the handle bracket 144 is shifted so that the head 154 of the stud 150 aligns with the enlarged portion 162 of the slot 160.

Figure 4:
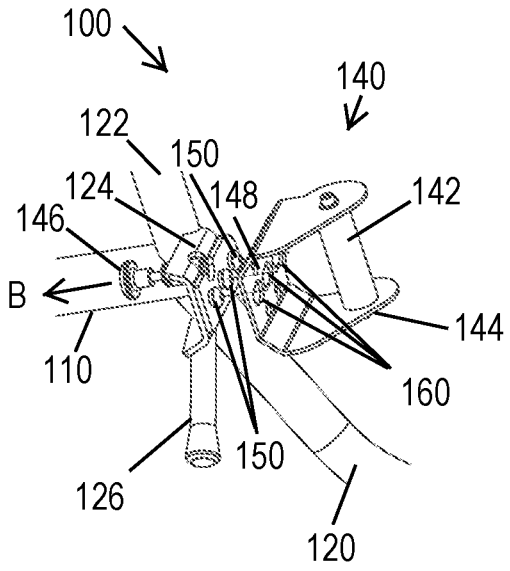
FIG. 4 is a detail view of a handle of the trap bar assembly of FIG. 1, during a first step of attaching the handle to the frame.
Figure 5:
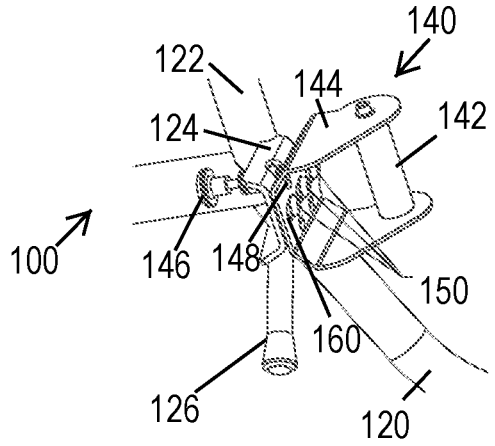
FIG. 5 is a detail view of the handle of FIG. 4, during a second step of attaching the handle to the frame.
Figure 6:
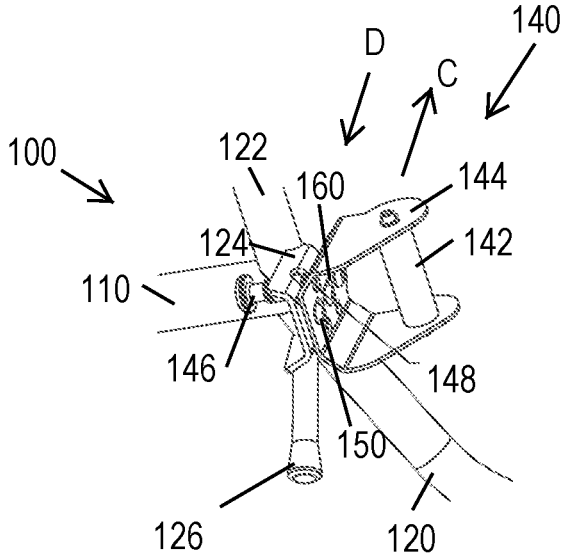
FIG. 6 is a detail view of the handle of FIG. 4, during a third step of attaching the handle to the frame.

Referring now to FIGS. 4-6, a sequence for attaching the handle 140 to the frame bracket 124 is illustrated. Referring first to FIG. 4, the handle 140 is positioned so that the one or more studs 150 of the frame bracket 124 are axially aligned with the enlarged portions 162 of the corresponding slots 160 of the handle bracket 144. The popper pin 146 is pulled away from the frame bracket 124 in the direction of arrow B to provide clearance for the handle bracket 144. As shown in FIG. 5, the handle bracket 144 is then brought into contact with the frame bracket 124, with the head 154 of each stud 150 passing through the enlarged portion 162 of the corresponding slot 160. As shown in FIG. 6, the handle bracket 144 is then slid along the frame bracket 124 in the direction of arrow C such that the shank 152 of each stud 150 is received in the narrow portion 164 of the corresponding slot 160. In this position, the aperture 148 in the handle bracket 144 is aligned with the popper pin 146. The popper pin 146 is released and engages the aperture 148 in the handle bracket 144, preventing movement of the handle bracket in the direction of arrows C and D. Thus, the handle bracket 144 is constrained to the frame bracket 124 by the engagement of the studs 150 with the slots 160 and by engagement of the popper pin 146 with the aperture 148. Specifically, the head 154 of the studs 150 prevents the handle bracket 144 from being pulled away from the frame bracket 124, and engagement of the popper pin 146 and the aperture 148 prevents the handle bracket 144 from sliding relative to the frame bracket 124 in the direction of arrows C and D.

Figure 7:
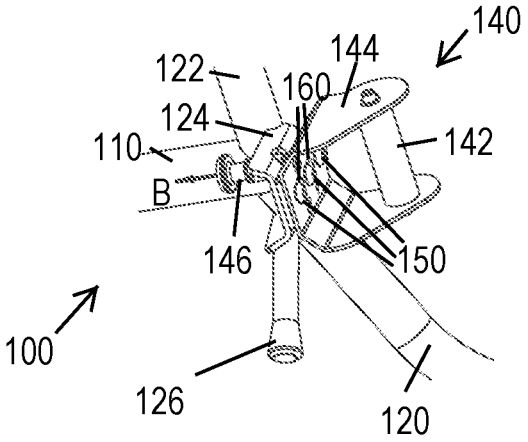
FIG. 7 is a detail view of the handle of FIG. 4, during a first step of detaching the handle from the frame.
Figure 8:
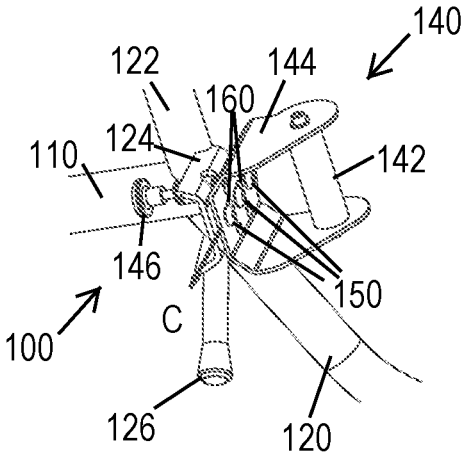
FIG. 8 is a detail view of the handle of FIG. 4, during a second step of detaching the handle from the frame.
Figure 9:
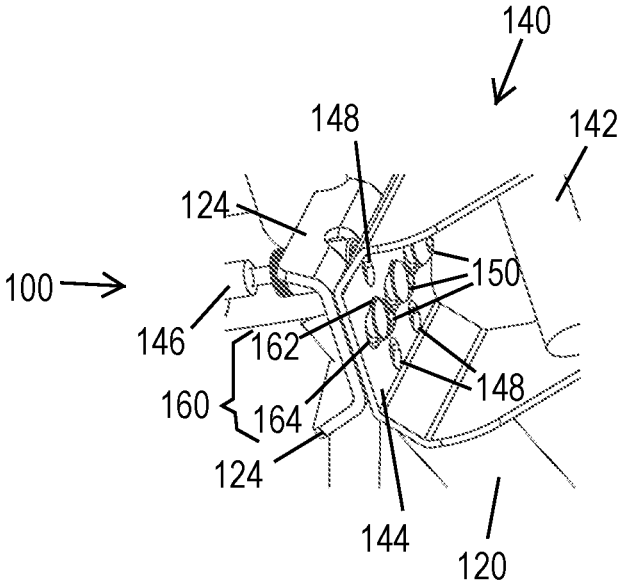
FIG. 9 is a detail view of the handle of FIG. 4, during a third step of detaching the handle from the frame.
Figure 10:
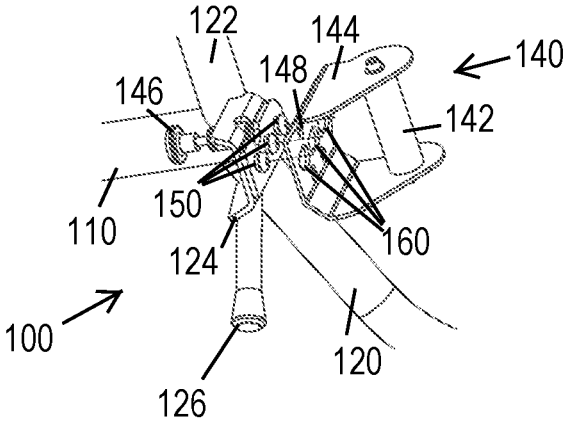
FIG. 10 is a detail view of the handle of FIG. 4, during a fourth step of detaching the handle from the frame.

FIGS. 7-10 illustrate how the handle 140 can be detached from the frame bracket 124, such as when the user wishes to change the handle 140 or reorient the handle 140. As shown in FIG. 7, the popper pin 146 is pulled in the direction of arrow B away from the frame bracket 124 and out of engagement with the aperture 148 of the handle bracket 144. With the popper pin 146 released from the aperture 148, the handle bracket 144 can be slid along the frame bracket 124 in the direction of arrow C, as shown in FIG. 8, until the head 154 of each stud 150 aligns with the enlarged portion 162 of the corresponding slot 160, as shown in FIG. 9. The handle bracket 144 may then be pulled away from the frame bracket 124, as shown in FIG. 10, with the head 154 of each stud 150 passing through the enlarged portion 162 of the corresponding slot 160.

Referring now to FIGS. 11-17, various embodiments of handles 140 are illustrated. The various handles 140 shown in FIGS. 11-17 may define different grip characteristics and may be interchangeably connected to the frame bracket 124 to change the grip characteristics of the trap bar assembly 100. For example, various embodiments of the handles 140 may facilitate a wider or narrower grip position, a pronated or supinated grip angle, and/or a higher or lower grip position. In all of the embodiments of FIGS. 11-17, the handles 140 include the same shape and spacing of slots 160 (although the number of slots 160 may differ), so that all of the handles 140 can be used interchangeably with the frame bracket 124.

Figure 11:
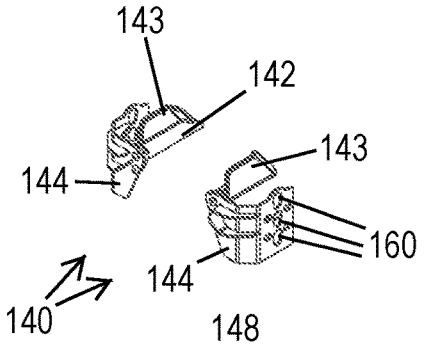
FIG. 11 is a perspective view of a pair of handles for a trap bar assembly according to a non-limiting embodiment of the present disclosure.
Figure 12:
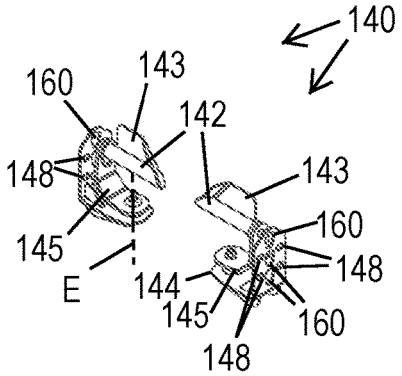
FIG. 12 is a perspective view of a pair of handles for a trap bar assembly according to a non-limiting embodiment of the present disclosure.

The handles 140 of the embodiments of FIGS. 11 and 12 include wings 143 projecting from the grip 142, which engage the palm of the user's hand to incorporate additional muscle groups into the exercise movement. In addition, the grips 142 of the embodiment of FIG. 12 are attached to a rotatable mount 145 that allows the grip 142 to be rotated about an axis E perpendicular to the axis A of the weight bars 110 (see FIG. 1). Rotation of the grip 142 about the axis E allows the user to change the pronation/supination angle of the grip to activate different muscle groups and/or to allow natural rotation of the user's wrists during exercise. The grips 142 may be lockable in a desired rotation position, or the grips 142 may be freely rotatable.

Figure 13:
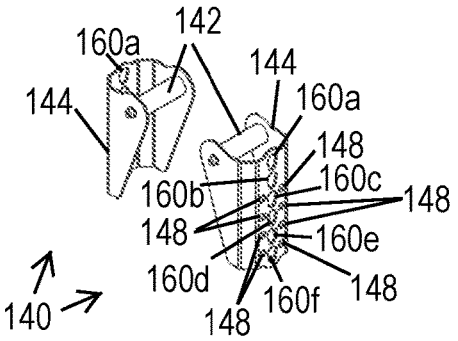
FIG. 13 is a perspective view of a pair of handles for a trap bar assembly according to a non-limiting embodiment of the present disclosure.

Referring now to the embodiment of the handles 140 shown in FIG. 13, the handle bracket 144 includes more slots **160*a*-160*f* than the number of studs 150 on the frame bracket 124. The handle 140 may thus be attached at a plurality of different heights on the frame bracket 124 by changing which of the slots 160*a*-160*f* engage the studs 150. This allows the user to raise or lower the initial height of the grip 142 when the trap bar assembly 100 is resting on the floor. Further details of the various manners in which the handles 140 shown in FIG. 13 can be connected to the frame bracket 124 are discussed in greater detail with reference to FIGS. 21 and 22**.

Figure 14:
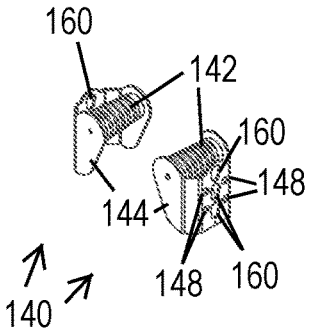
FIG. 14 is a perspective view of a pair of handles for a trap bar assembly according to a non-limiting embodiment of the present disclosure.

Referring now to the embodiment of the handles 140 shown in FIG. 14, the grips 142 may be oversized relative to a traditional grip size to increase activation of the user's forearms. Referring now to the embodiment of the handles 140 shown in FIG. 15, the grips 142 may be undersized relative to a traditional grip size so that grip strength is not the limiting factor in the user's ability to lift the trap bar assembly 100.

Figure 15:
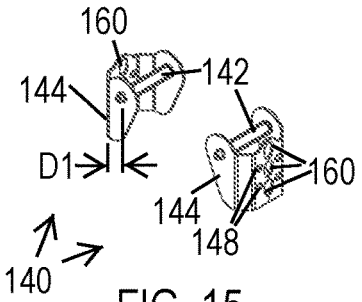
FIG. 15 is a perspective view of a pair of handles for a trap bar assembly according to a non-limiting embodiment of the present disclosure.
Figure 16:
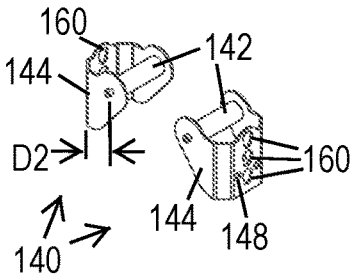
FIG. 16 is a perspective view of a pair of handles for a trap bar assembly according to a non-limiting embodiment of the present disclosure.
Figure 17:
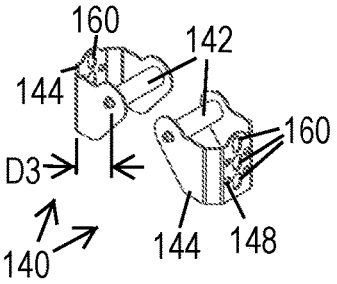
FIG. 17 is a perspective view of a pair of handles for a trap bar assembly according to a non-limiting embodiment of the present disclosure.

With continued reference to FIG. 15 and additional reference to FIGS. 16 and 17, the grips 142 of various embodiments of the handles 140 may be spaced apart from the corresponding handle brackets 144 by varying amounts to set a grip width between the grips 142 when the handles 140 are attached to frame brackets 124. In the embodiment shown in FIG. 15, the grips 142 are spaced a first distance D1 from the corresponding handle bracket 144. In the embodiment shown in FIG. 16, the grips 142 are spaced a second distance D2 from the corresponding handle bracket 144. The second distance D2 of the embodiment of FIG. 16 is greater than the first distance D1 of the embodiment of FIG. 15. As such, the handles 140 of the embodiment of FIG. 16 create a narrower grip width than the embodiment of FIG. 15 because the grips 142 of the opposing handles 140 are closer to one another when the trap bar assembly 100 is assembled. The grips 142 of the embodiment of FIG. 17 are spaced apart from the corresponding handle brackets 144 by a third distance D3 greater than the second distance D2 of the embodiment of FIG. 16.

Figure 18:
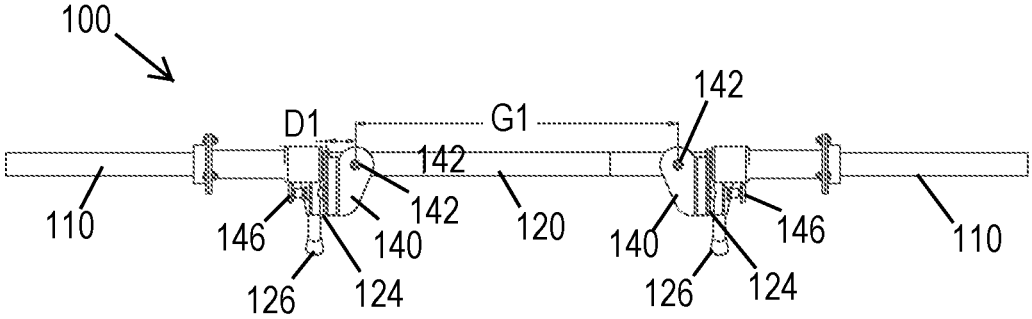
FIG. 18 is a front view of a trap bar assembly according to a non-limiting embodiment of the present disclosure, including the handles of FIG. 15.
Figure 19:
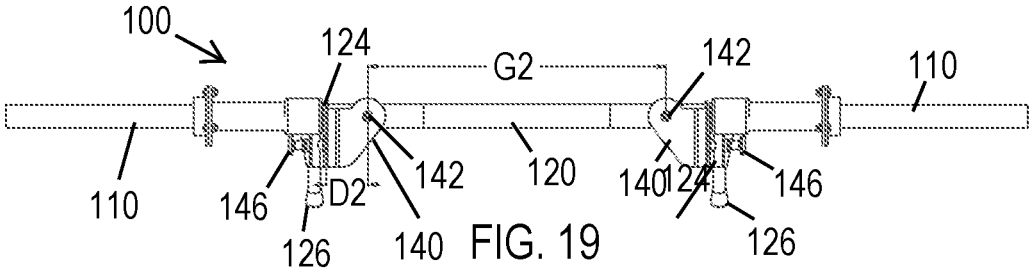
FIG. 19 is a front view of a trap bar assembly according to a non-limiting embodiment of the present disclosure, including the handles of FIG. 16.
Figure 20:
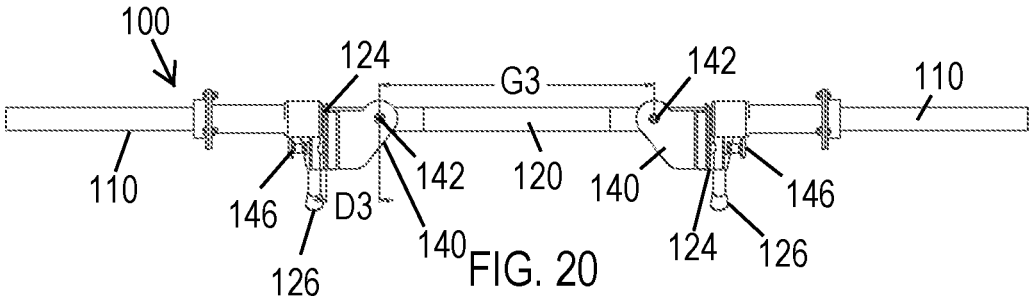
FIG. 20 is a front view of a trap bar assembly according to a non-limiting embodiment of the present disclosure, including the handles of FIG. 17.

Referring now to FIGS. 18-20, the trap bar assembly 100 is illustrated including the handles 140 of the embodiments of FIGS. 15-17, respectively. FIG. 18 illustrates the trap bar assembly 100 utilizing the handles 140 of FIG. 15, resulting in a first grip width G1 between the grips 142. The first grip width G1 corresponds to a distance between the opposing frame brackets 124, minus the first distance D1 of each handle 140. FIG. 19 illustrates the trap bar assembly 100 utilizing the handles 140 of FIG. 16, resulting in a second grip width G2 between the grips 142. The second grip width G2 corresponds to a distance between the opposing frame brackets 124, minus the second distance D2 of each handle 140. The second grip width G2 is less than the first grip width G1 of FIG. 18 due to the second distance D2 being larger than the first distance D1. FIG. 20 illustrates the trap bar assembly 100 utilizing the handles 140 of FIG. 17, resulting in a third grip width G3 between the grips 142. The third grip width G3 corresponds to a distance between the opposing frame brackets 124, minus the third distance D3 of each handle 140. The third grip width G3 is less than the second grip width G2 of FIG. 19 due to the third distance D3 being larger than the second distance D2.

In some embodiments, the first distance D1 may be approximately 2.5 inches, the first grip width G1 may be approximately 27 inches, the second distance D2 may be approximately 3.5 inches, the second grip width G2 may be approximately 25 inches, the third distance D3 may be approximately 4.5 inches, and the third grip width G3 may be approximately 23 inches.

Figure 21:
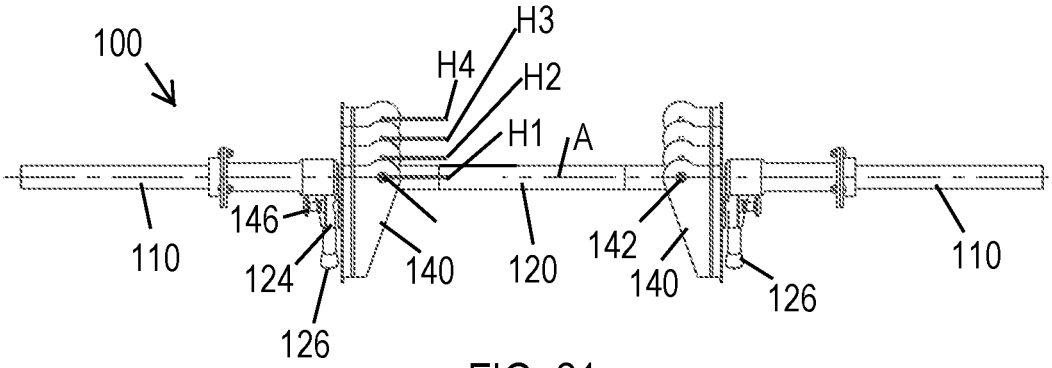
FIG. 21 is a front view of a trap bar assembly according to a non-limiting embodiment of the present disclosure, including the handles of FIG. 13 in a first orientation.

Referring now to FIG. 21, the trap bar assembly 100 is illustrated using the handles 140 of FIG. 13 in various attachment positions relative to the frame brackets 124. With a set of topmost slots 160*a*-160*c* (see FIG. 13) of the handles 140 engaged to the studs 150, the grips 142 may be substantially in plane with the axis A, corresponding to a first height H1. With a second set of slots 160*b*-160*d* engaged to the studs 150, the grips 142 may be elevated from the axis A by a second height H2. With a third set of slots 160*c*-160*e* engaged to the studs 150, the grips 142 may be elevated from the axis A by a third height H3. With a lowermost set of slots 160*d*-160*f* engaged to the studs 150, the grips 142 may be elevated from the axis A by a fourth height H4. In some embodiments, the second height H2 may correspond to a distance of approximately 1.63 inches between the axis A and the grips 142, the third height H3 may correspond to a distance of approximately 3.25 inches between the axis A and the grips 142, and the fourth height H4 may correspond to a distance of approximately 4.88 inches between the axis A and the grips 142.

Figure 22:
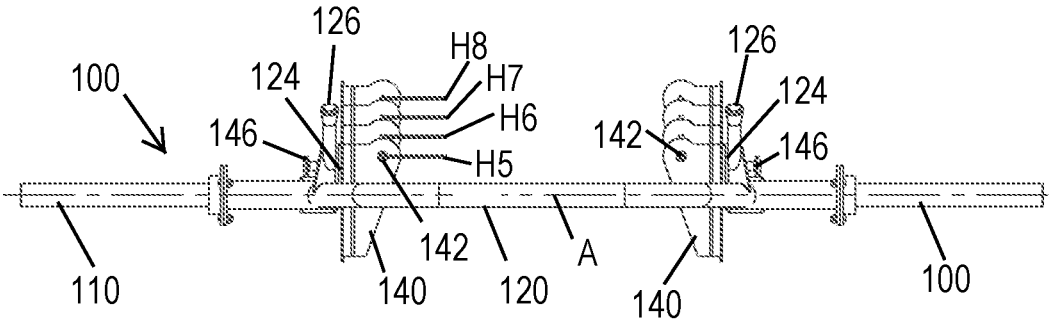
FIG. 22 is a front view of a trap bar assembly according to a non-limiting embodiment of the present disclosure, including the handles of FIG. 13 in a second orientation.

Referring now to FIG. 22, the handles 140 may be configured to be rotated by approximately 180° about the axis A to allow for further height adjustment of the grips 142. As shown in FIG. 22, the frame 120 is rotated 180° from the position shown in FIG. 21, as evident by the popper pins 146 being above the weight bars 110 rather than below the weight bars 110. When attaching the handles 140 in the positions shown in FIG. 22, the popper pin 146 falls on the opposite side of the slots 160*a*-160*f* as compared to the positions shown in FIG. 21. To facilitate engagement with the popper pin 146 in either the positions of FIG. 21 or FIG. 22, the handle bracket 144 may include apertures 148 on both sides of the slots 160*a*-160*f*, as can be appreciated from FIG. 13.

Continuing reference to FIG. 22, with the topmost set of slots 160*a*-160*c* (see FIG. 13) of the handles 140 engaged to the studs 150, the grips 142 may be elevated from the axis A by a fifth height H5. With the second set of slots 160*b*-160*d* engaged to the studs 150, the grips 142 may be elevated from the axis A by a sixth height H6. With the third set of slots 160*c*-160*e* engaged to the studs 150, the grips 142 may be elevated from the axis A by a seventh height H7. With the lowermost set of slots 160*d*-160*f* engaged to the studs 150, the grips 142 may be elevated from the axis A by an eighth height H8. In some embodiments, the fifth height H5 may correspond to a distance of approximately 3.25 inches between the axis A and the grips 142, the sixth height H6 may correspond to a distance of approximately 4.88 inches between the axis A and the grips 142, the seventh height H7 may correspond to a distance of approximately 6.50 inches between the axis A and the grips 142, and the eighth height H8 may correspond to a distance of approximately 8.13 inches between the axis A and the grips 142.

Figure 23:
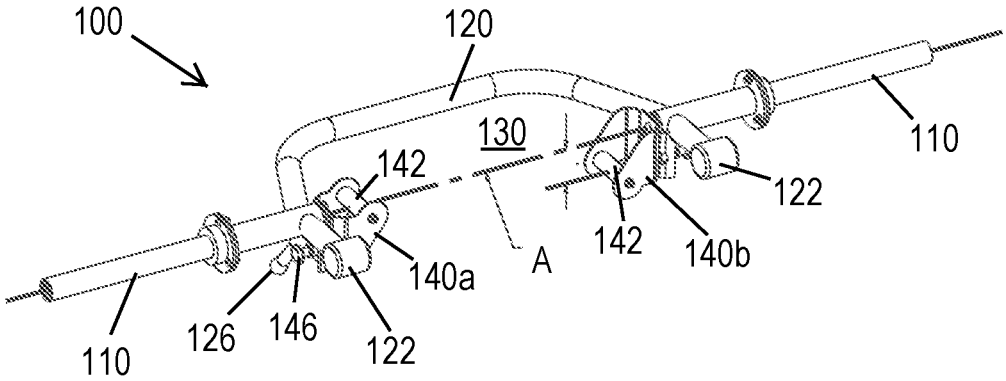
FIG. 23 is a perspective view of a trap bar assembly according to a non-limiting embodiment of the present disclosure.

FIG. 23 further illustrates the ability of the handles 140 to be rotated 180° on the frame brackets 124 to adjust the height of the grip 142. A first handle 140*a* is shown attached to the corresponding frame bracket 124 in a first orientation so that the grip 142 is substantially co-planar with the axis A of the weight bars 110. A second handle 140*b* is shown attached to the corresponding frame bracket 124 in a second orientation, rotated about the axis A by approximately 180° relative to the first handle 140*a*, so that the grip 142 of the second handle 140*b* is below the axis A. As noted in connection with FIG. 22, the handle brackets 144 may include apertures 148 on both sides of the slots 160 so that the popper pins 146 can engage an aperture 148 of the handles 140*a*, 140*b* in either orientation shown in FIG. 23.

Figure 24:
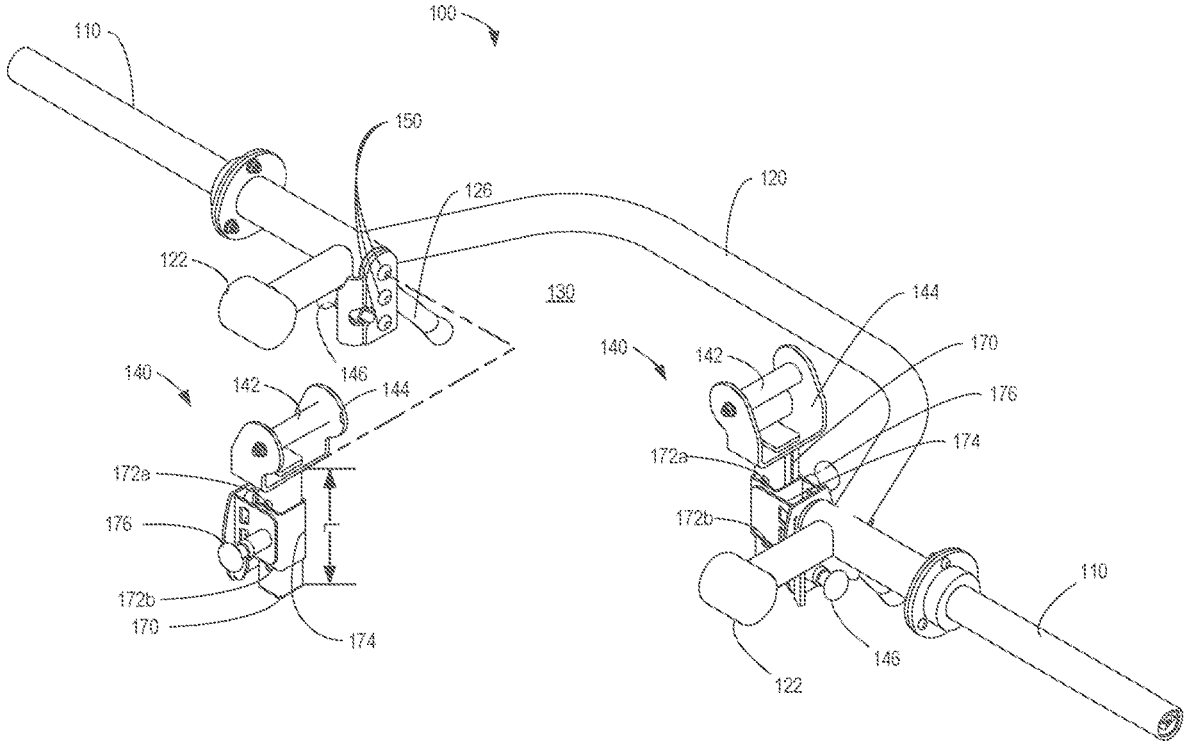
FIG. 24 is a perspective view of a pair of handles for a trap bar assembly and a trap bar assembly according to a non-limiting embodiment of the present disclosure.

Referring now to the embodiment of the handles 140 shown in FIG. 24, the handle bracket 144 may comprise an elongated portion 170 and a sleeve 174. The elongated portion 170 may extend away from the portion of the handle bracket 144 that attaches to the grip 142. The elongated portion 170 may have a length L and may include a plurality of apertures 172*a*, 172*b* spaced apart along the length L. The sleeve 174 may be connected to the frame bracket 124 and may be positioned around the elongated portion 170, such that the elongated portion 170 may slide back and forth relative to the sleeve 174. The sleeve 174 may be attached to the elongated portion 170 of the handle bracket 144 via a locking mechanism, such as a popper pin 176. The popper pin 176 may be the same as the popper pin 146, such that it is biased toward a locked position in which the popper pin 176 engages a corresponding aperture 172 of the plurality of apertures 172*a*, 172*b*. The at least one slot 160, such as a plurality of slots 160, and the aperture 148 (not shown) for engaging with the popper pin 146 may be positioned on the sleeve 174 of the handle bracket 144. In some non-limiting embodiments, the popper pin 176 may engage with a specific aperture 172 of the plurality of apertures 172*a*, 172*b* to give the handle 140 a certain height above the rest of the trap bar assembly 100. For example, the popper pin 176 may engage a first aperture 172*a* giving the handle 140 a first height, or the popper pin 176 may engage a second aperture 172*b* going the handle 140 a second height. The height of the handle 140 above the rest of the trap bar assembly 100 may be higher when the popper pin 176 is engaged with the second aperture 172*b* compared to the popper pin 176 engaging with the first aperture 172*a*. In some non-limiting embodiments, the popper pin 176 may first engage a first aperture 172*a* of the plurality of apertures 172*a*, 172*b*, then disengage from the first aperture 172*a* and engage with another aperture 172*b* of the plurality of apertures 172*a*, 172*b*.

Figure 25:
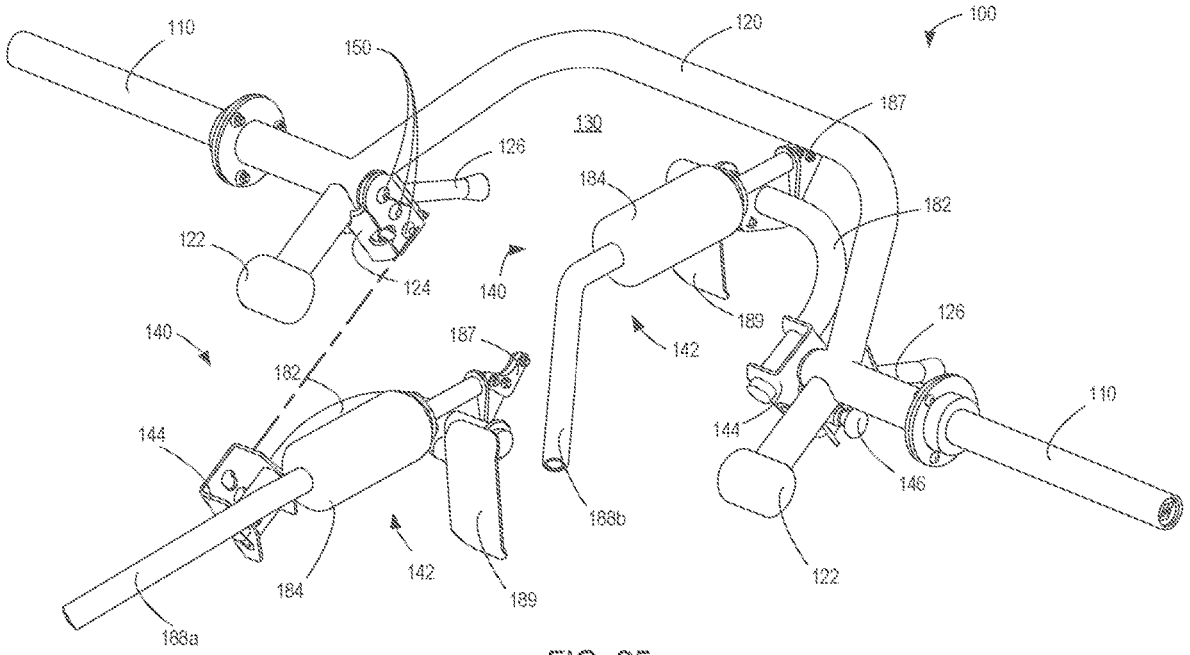
FIG. 25 is a perspective view of a pair of handles for a utility bar assembly and a utility bar assembly according to a non-limiting embodiment of the present disclosure.

Referring now to the embodiment of the handles 140 shown in FIG. 25, the grip 142 may comprise a connecting portion 182, a padded portion 184, and a grip portion 188. In such an embodiment, the interchangeable handles or attachments 140 facilitate exercises different from traditional trap bars. Assemblies 100 that have the option of including interchangeable handles or attachments 140 which facilitate exercises different from traditional trap bars, such as the attachments 140 of FIGS. 25 and 26, may be referred to as utility bar assemblies 100, even if the assembly also has the option of including interchangeable handles 140 that do facilitate exercises of traditional trap bars.

The connecting portion 182 of the grip 142 may be connected to the handle bracket 144. The connecting portion 182 may have a certain shape. The shape of the connecting portion 182 may be curved, such as curved to correspond to a curve of the central frame 120. The connecting portion 182 may have a certain shape so as to position the padded portion 184 and the grip portion 188 in a certain location within the open region 130. For example, the connecting portion 182 may have a shape such that, when a user is present in the open region, the padded portion 184 may be positioned on a shoulder of the user and the grip portion 188 may be grasped by the user. The grip portion 188 may be connected to the connecting portion 182. The grip portion 188 may have a substantially linear shape, such as the grip portion 188*a*, or the grip portion 188 may have a bent shape, such as the grip portion 188*b*. The grip portion 188 may comprise any other shape that is suitable for gripping by a user. The padded portion 184 may be positioned over at least a portion of the grip portion 188, such that the padded portion 184 covers at least a portion of the grip portion 188. The padded portion 184 may comprise various materials, such as foam, plastics, fabrics, and/or the like. The padded portion 184 may be configured to protect a certain body part of the user, such as a shoulder, from contact with the grip portion 188 during use of the utility bar assembly 100. The grip 142 may further comprise a recessed portion 187 connected to the connecting portion 186. The recessed portion 187 may be connected to the connecting portion 186 on the opposite side of the connecting portion 186 from the grip portion 188. For example, the recessed portion 187 may be connected to the connecting portion 186 such that, when the handle 140 is connected to the central frame 120, the recessed portion 187 abuts the central frame 120. The recessed portion 187 may have a shape that defines a recess. This shape of the recessed portion 187 defining the recess may correspond to the shape of the outer curvature of the central frame 120, such that, when the handle 140 is connected to the central frame 120, the portion of the central frame 120 that abuts the recessed portion 187 sits in the recess. The grip 142 may further include a back-support portion 189 connected to the connecting portion 186. The back-support portion 189 may include a substantially planar surface and configured to engage a user's upper back. The back-supporting portion 189 will distribute the load of the utility bar assembly 100 over the area of the user's back.

Figure 26:
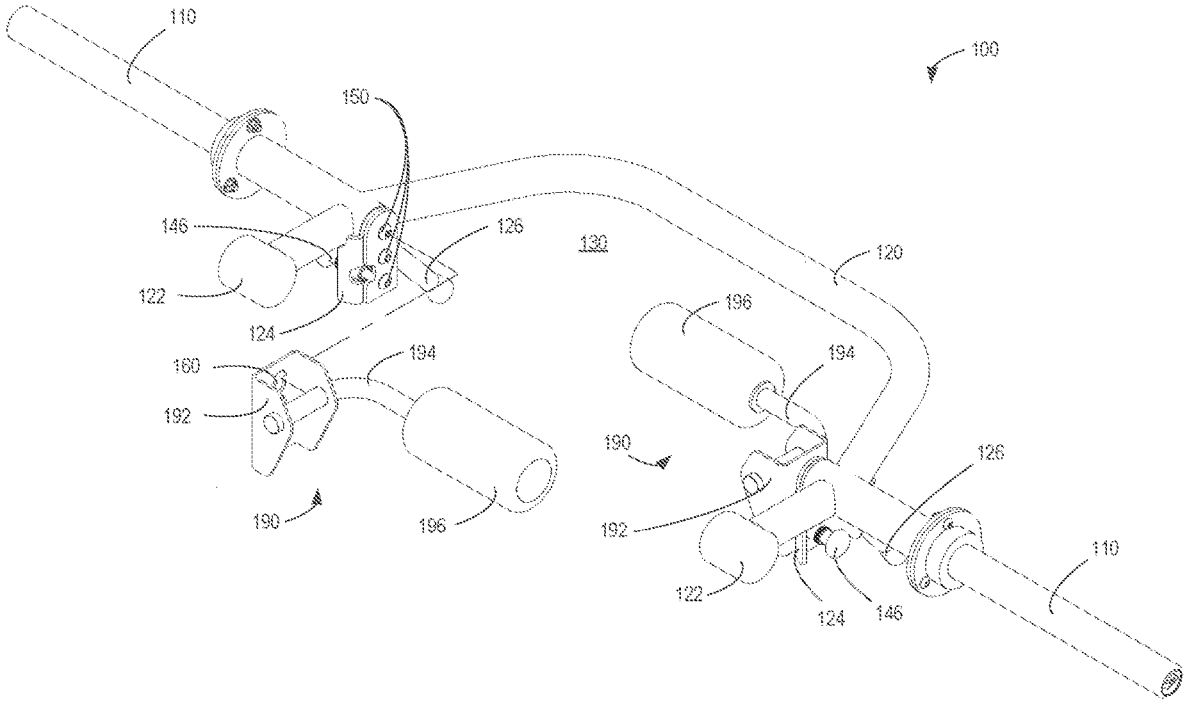
FIG. 26 is a perspective view of a pair of interchangeable attachments and a utility bar assembly according to a non-limiting embodiment of the present disclosure.

Referring now to FIG. 26, the utility bar assembly 100 may include other interchangeable attachments other than handles 140. Referring now to the interchangeable attachments of FIG. 26, the utility bar assembly 100 may comprise hip flex attachments 190. The hip flex attachment 190 may comprise an attachment bracket 192 connected to the frame bracket 124. The attachment bracket 192 may comprise at least one slot 160, such as a plurality of slots 160, for engaging with the studs 150 and an aperture 148 (not shown) for engaging with the popper pin 146. The hip flex attachment 190 may comprise a connecting portion 194 connected to the attachment bracket 192. The connecting portion 194 may have a certain shape. The shape of the connecting portion 194 may be curved, such as curved to correspond to a curve of the central frame 120. The connecting portion 194 may have a certain shape so as to position the padded portion 196 in a certain location within the open region 130. For example, the connecting portion 194 may have a shape such that a user can position the padded portion 196 against their waist on the front side of their body and grasp the central frame 120 with their hands. The hip flex attachment 190 may comprise a padded portion 196 positioned over at least a portion of the connecting portion 194, such that the padded portion 196 covers at least a portion of the connecting portion 194. The padded portion 196 may comprise various materials, such as foam, plastics, fabrics, and/or the like. The padded portion 196 may be configured to protect a certain body part of the user, such as the user's hips/waist, from contact with the connecting portion 194 during use of the utility bar assembly 100.

Figure 27:
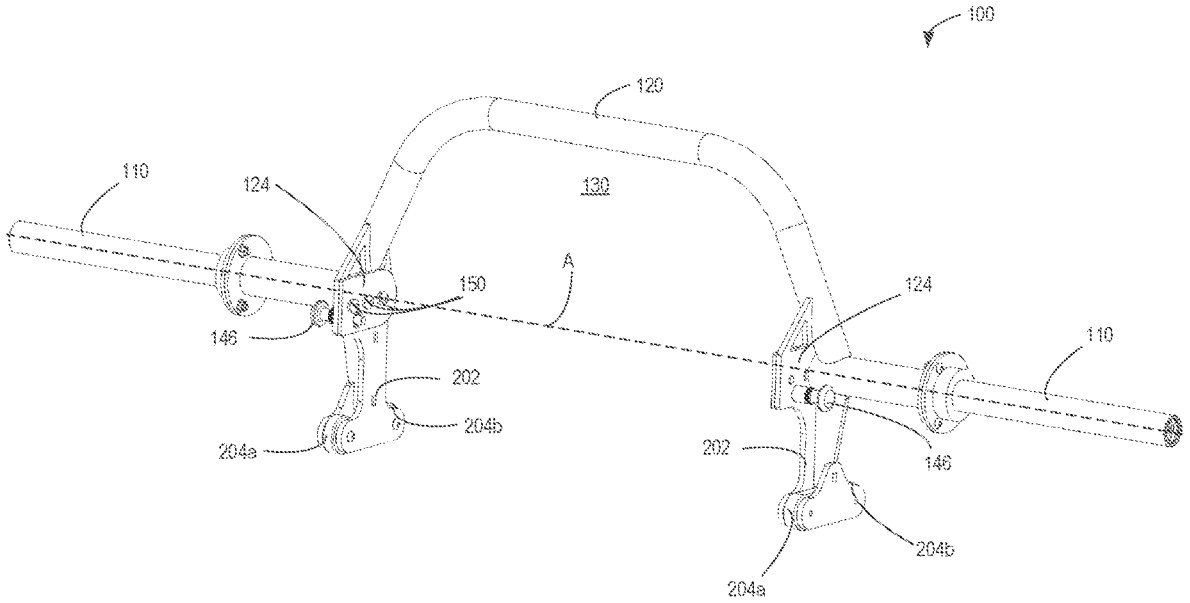
FIG. 27 is a perspective view of a trap bar assembly according to a non-limiting embodiment of the present disclosure.

Referring to the trap bar assembly 100 of FIG. 27, the trap bar assembly 100 may comprise one or more wheels 204*a*, 204*b*. The one or more wheels 204*a*, 204*b* may be connected to the frame bracket 124 and/or the central frame 120. The trap bar assembly 100 may comprise an elongated portion 202 connected to the frame bracket 124 and/or the central frame 120 on one end, and to the one or more wheels 204*a*, 204*b* on the other end. The elongated portion 202 may extend perpendicular to the axis A and along the same plane as the central frame 120. The elongated portion 202 may have a length such that the one or more wheels 204*a*, 204*b* may contact the ground, even if weights are present on weight bars 110. This allows for the trap bar assembly 100 to rest on the one or more wheels 204*a*, 204*b*, with the central portion 120 extending upwardly.

Figure 28:
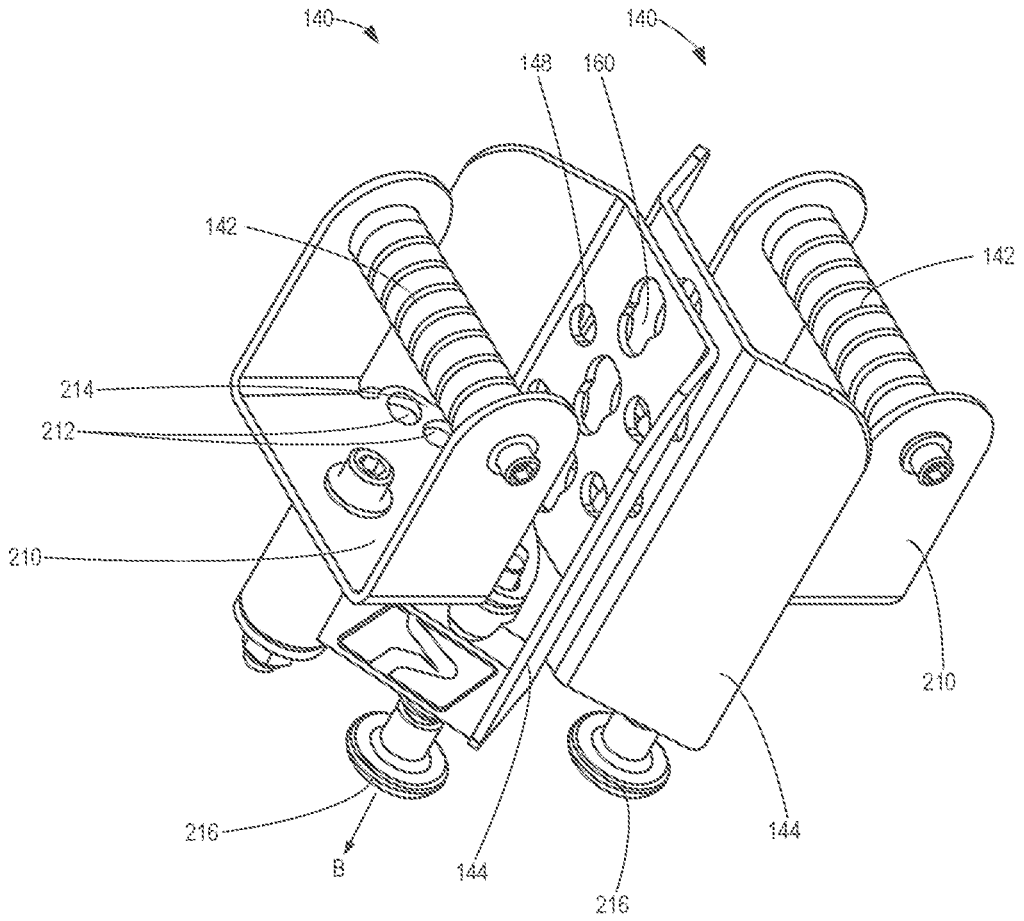
FIG. 28 is a perspective view of a pair of handles for a trap bar assembly according to a non-limiting embodiment of the present disclosure.

Referring to the interchangeable handles 140 of FIG. 28, the handle bracket 144 may include a rotatable grip mount 210. The rotatable grip mount 210 is connected to the grip 142 and is rotatably mounted on the handle bracket 144. In this way, the rotatable grip mount 210 may rotate to a specific angle which in turn changes the angle in which a user would grasp the grip 142. The rotatable grip mount 210 may have a rotational range of motion of at least 90°, or at least 135°, or at least 180°, or at least 225°, or at least 270°, or at least 315°, or the rotatable grip mount 210 may have a full range of motion of 360°. The rotatable grip mount may include a plurality of apertures 212. The plurality of apertures 212 may be positioned equally spaced apart and along the outer edge 214 of the rotatable grip mount 210. The plurality of apertures 212 may include at least 2, or at least 3, or at least 4, or at least 5, or at least 10 apertures 212. The rotatable grip mount 210 may be prevented from rotating via a locking mechanism. For example, the handle bracket 144 may include a popper pin 216. The popper pin 216 is biased toward a locked position in which the popper pin 216 engages a corresponding aperture of the plurality of apertures 212. The popper pin 216 is pulled in the direction B which disengages the popper pin 216 from an aperture of the plurality of apertures 212. A user may then rotate the rotatable grip mount 210 to the desired grip angle. Once the grip 142 is angled as the user desires, the popper pin 216 is released, returning to its biased locked position and engaging with an aperture of the plurality of apertures 212, thereby locking the grip 142 at the desired angle.

While the foregoing description and accompanying drawings show the one or more studs 150 extending from the plate bracket 124 and the one or more slots 160 defined in the frame bracket 144, other embodiments may have the one or more studs 150 extending from the handle bracket 144 and the one or more slots 160 defined in the frame bracket 124.

The trap bar assembly 100 may be supplied to the user as a system, including multiple embodiments of the handles 140 as described herein so that the user may interchange the handles 140 as desired to perform different exercise movements and/or target different muscle groups.

While various embodiments of a trap bar assembly were provided in the foregoing description, those skilled in the art may make modifications and alterations to these aspects without departing from the scope and spirit of the invention. For example, it is to be understood that this disclosure contemplates that, to the extent possible, one or more features of any aspect can be combined with one or more features of any other aspect. Accordingly, the foregoing description is intended to be illustrative rather than restrictive. The invention described hereinabove is defined by the appended claims, and all changes to the invention that fall within the meaning and the range of equivalency of the claims are to be embraced within their scope.

The invention claimed is:

1. A trap bar assembly, comprising:

a central frame at least partially defining an open region;

a pair of weight bars each extending from the central frame along a common axis, wherein the common axis extends through the open region; and a frame bracket connected to the central frame, wherein the frame bracket is removably connectable to any of a plurality of interchangeable handles, wherein each of the plurality of interchangeable handles comprises a handle bracket and a grip, wherein the handle bracket is removably connectable to the frame bracket, wherein one of the frame bracket and the handle bracket comprises at least one stud, wherein another of the frame bracket and the handle bracket comprises at least one slot configured to receive the at least one stud, wherein each of the at least one stud comprises a shank and a head having a greater diameter than the shank, wherein each of the at least one slot defines an enlarged portion and a narrow portion, wherein the enlarged portion is sufficiently large for the head of a corresponding stud to pass through, and wherein the narrowed portion is too small for the head of the corresponding stud to pass through.

2. The trap bar assembly of claim 1, wherein a first of the plurality of interchangeable handles defines a different grip characteristic than a second of the plurality of interchangeable handles.

3. The trap bar assembly of claim 2, wherein the grip characteristic comprises at least one of:

a grip width;

a grip height;

a grip size; and a grip angle.

4. The trap bar assembly of claim 1, further comprising:

a popper pin mounted to the frame bracket, wherein the popper pin is configured to engage an aperture in the handle bracket to prevent the handle bracket from sliding relative to the frame bracket.

5. A trap bar assembly comprising:

a central frame at least partially defining an open region;

a pair of weight bars each extending from the central frame along a common axis, wherein the common axis extends through the open region;

a frame bracket connected to the central frame; and a handle comprising:

a handle bracket removably connectable to the frame bracket; and a grip connected to the handle bracket, wherein one of the frame bracket and the handle bracket comprises at least one stud, wherein another of the frame bracket and the handle bracket comprises at least one slot configured to receive the at least one stud, wherein each of the at least one stud comprises a shank and a head having a greater diameter than the shank, wherein each of the at least one slot defines an enlarged portion and a narrow portion, wherein the enlarged portion is sufficiently large for the head of a corresponding stud to pass through, and wherein the narrowed portion is too small for the head of the corresponding stud to pass through.

6. The trap bar assembly of claim 5, further comprising:

a popper pin mounted to the frame bracket, wherein the popper pin is configured to engage an aperture in the handle bracket to prevent the handle bracket from sliding relative to the frame bracket.

7. The trap bar assembly of claim 5, wherein a number of slots is greater than a number of studs, and wherein a height of the grip relative to the common axis is adjustable by changing which of the one or more slots are engaged to the one or more studs.

8. The trap bar assembly of claim 5, wherein the handle is connectable to the frame bracket in a first orientation, and wherein the handle is connectable to the frame bracket in a second orientation rotated approximately 180° relative to the first orientation.

9. A utility bar assembly comprising:

a central frame at least partially defining an open region;

a pair of weight bars each extending from the central frame along a common axis, wherein the common axis extends through the open region;

a frame bracket connected to the central frame; and a hip flex attachment comprising an attachment bracket removably connected to the frame bracket, a connecting portion connected to the attachment bracket, and a padded portion positioned over at least a portion of the connecting portion.

10. The utility bar assembly of claim 9, further comprising one or more wheels connected to the frame bracket and/or to the central frame.

11. A utility bar assembly comprising:

a central frame at least partially defining an open region;

a pair of weight bars each extending from the central frame along a common axis, wherein the common axis extends through the open region;

a frame bracket connected to the central frame; and an interchangeable handle comprising a handle bracket and a grip, wherein the handle bracket is removably attached to the frame bracket;

wherein the grip comprises a connecting portion connected to the handle bracket, a grip portion connected to the connecting portion, and a padded portion positioned over at least a portion of the grip portion;

wherein the grip further comprises a back-support portion connected to the connecting portion and configured to engage the upper back of a user.

12. The utility bar assembly of claim 11, wherein the handle bracket comprises an elongated portion extending away from the grip, and a sleeve removably connected to the frame bracket, wherein the sleeve is connected to and positioned around at least a portion of the elongated portion.

13. The utility bar assembly of claim 11, further comprising one or more wheels connected to the frame bracket and/or to the central frame.

* * * * *